US007794122B2

(12) United States Patent
Godfrey et al.

(10) Patent No.: US 7,794,122 B2
(45) Date of Patent: Sep. 14, 2010

(54) LAMP RETAINING SYSTEM FOR TRAFFIC SIGNALS

(75) Inventors: Scott Godfrey, 18 Aubrey Avenue, Richmond Hill, Ontario (CA) L4E 1A4; Paul Arato, Toronto (CA)

(73) Assignee: Scott Godfrey, Ontario (CA)

( * ) Notice: Subject to any disclaimer, the term of this patent is extended or adjusted under 35 U.S.C. 154(b) by 250 days.

(21) Appl. No.: 12/144,101

(22) Filed: Jun. 23, 2008

(65) Prior Publication Data

US 2009/0316419 A1 Dec. 24, 2009

(51) Int. Cl.
*F21V 21/088* (2006.01)

(52) U.S. Cl. ..... 362/396; 362/549; 362/655; 362/457; 362/458; 362/374

(58) Field of Classification Search ..... 362/396, 362/457, 458, 549, 655, 374
See application file for complete search history.

(56) References Cited

U.S. PATENT DOCUMENTS

| | | | | |
|---|---|---|---|---|
| 3,219,973 | A * | 11/1965 | Lenz | 362/455 |
| 4,117,456 | A * | 9/1978 | Albrecht | 362/374 |
| 4,369,429 | A * | 1/1983 | Souder | 362/391 |
| 4,510,559 | A | 4/1985 | Kristofek | |
| 4,700,278 | A | 10/1987 | Chew | |
| 6,268,801 | B1 | 7/2001 | Wu | |
| 6,676,176 | B1 | 1/2004 | Quandt | |
| 6,911,915 | B2 | 6/2005 | Wu et al. | |
| 2002/0089419 | A1 | 7/2002 | Martineau | |
| 2007/0139921 | A1 | 6/2007 | Wu | |

FOREIGN PATENT DOCUMENTS

| | | |
|---|---|---|
| AU | 408960 B2 | 12/1970 |
| DE | 20 2006014987 | 12/2006 |
| EP | 1426520 A1 | 6/2004 |
| EP | 1870602 A1 | 12/2007 |

OTHER PUBLICATIONS

European Search Report, Sep. 10, 2009; 2 pages.

* cited by examiner

*Primary Examiner*—Stephen F Husar
*Assistant Examiner*—James W Cranson
(74) *Attorney, Agent, or Firm*—Banner & Witcoff, Ltd.

(57) ABSTRACT

Locking clips are provided for attaching a lamp assembly in a traffic signal housing. The clips use a fixed first portion and a movable second portion. The second portion locks to the first portion or to the housing itself and retains an edge of the lamp assembly, holding it in a window of the housing. Foldable/hinged interlocking clips are provided. Other alternatives include slidable clips that engage a fixed element on the housing (e.g. a fixed pin, or a trough in the housing wall), and rotatable clips that engage a fixed element on the housing (e.g. a fixed pin, or a trough in the housing wall). The clips may be part of a retaining system or a traffic signal. Optional lower holders may also be provided. The invention also includes a method for replacing a lamp assembly in a traffic signal housing with at least one locking clip.

26 Claims, 9 Drawing Sheets

LAMP RETAINING SYSTEM FOR TRAFFIC SIGNALS

FIELD OF THE INVENTION

The invention relates to traffic signals and, more particularly, to the lamp portions of traffic signals.

BACKGROUND OF THE INVENTION

Traffic signals have been used for many years. In North America alone, it is estimated that there are over 330 thousand signalized intersections. For municipalities and other road authorities, installation and maintenance of traffic signals can be a major budget item.

One form of traffic signal uses an incandescent bulb that is threaded to a lamp socket (or base) installed in a reflector assembly within a back recess of the signal housing where the bulb accesses a power source. The light bulb's white light is transmitted through a translucent lens that is colored (usually solid red, yellow, or green). This dome-shaped lens is installed in the front window of the housing. It is held in place in the window by a set of (usually four) mounting brackets (or "lens clips"). The mounting brackets are substantially flat stamped pieces of metal (usually stainless steel or aluminum) that are, more-or-less permanently, screwed onto the front door of the traffic signal housing (usually one in each corner). The mounting bracket extends over the circumferential lip of the lens to hold the lens in place.

To change the light bulb, a technician opens the traffic signal housing, unthreads the burnt out light bulb from the socket, screws in a new light bulb, then closes the housing. This is a relatively simple procedure. However, to replace the lens a technician needs to unscrew each of the mounting brackets (trying not to drop or lose the tiny screws or the brackets themselves), remove the broken or damaged lens, then replace the lens with a new one, reattaching the mounting brackets by re-fastening the screws with a screwdriver (while holding the lens in place).

These replacements are typically done by a technician on-site. The technician is in an awkward position—raised up in a "bucket" of a crane truck. The buckets tend to sag and sway in high winds. The technician must work quickly and carefully. The traffic signal usually needs to be disabled to carry out this maintenance work, so time is of the essence. Since the signal is outdoors, the technician may also be working in less than ideal weather conditions or under cover of night. He may further be using gloves to do the replacement, adding to the difficulty. All of these factors make simple operations more difficult.

A recent development is the use of light emitting diodes (LED's) in traffic signals. Gradually, road authorities in various jurisdictions have been switching over from the conventional incandescent light-based traffic signals to LED-based traffic signals, which last longer and require less power than incandescent light bulbs. It is estimated that roughly 75% of the traffic signals in North America have been converted to LED. One way this change has been implemented has been by retrofitting signals designed for incandescent-type lamps to use an LED lamp kit.

LED lamp kits are structured differently than traditional incandescent lamps. Instead of having a separate lens, bulb, socket/reflector and power supply, the LED lamp kit is a self-contained unit. All of these parts are in one package. An array of LED bulbs is mounted on a circuit board. The circuit board is connected to a power supply. A colored or clear dome lens is attached over the circuit board. All of these parts are contained in a single sealed "kit". One standard type of kit is a round disc-shaped kit (there are also square and rectangular kits). The diameter of the round kit is commonly 8 inches (200 mm), 12 inches (300 mm) or 16 inches (400 mm). To retrofit the incandescent housing, the socket and reflector are removed, the lens is removed, and the LED lamp kit is simply installed in place of the lens. The lamp kit is attached using the same screw-fastened mounting brackets that were formerly used to hold the lens in the incandescent model.

A problem with this retrofit is that the LED lamp kits must be replaced at fairly frequent intervals. Unlike the lenses of the incandescent model (which were infrequently —if ever— replaced after installation), the LED lamp kits are routinely swapped out for fresh kits approximately every 3-5 years. Therefore, the technician is confronted with the hassles of dealing with the screw-fastened mounting brackets much more frequently.

It would be desirable to provide a system whereby either lenses or full LED lamp kits can be easily replaced in a traffic signal without the need for detachable parts or tools, allowing the technician to carry out the replacement simply and effectively.

SUMMARY OF THE INVENTION

According to a first aspect of the invention, a locking clip is provided for attaching a lamp assembly to a traffic signal housing. The housing has a front wall defining a window through which the lamp assembly is visible. The clip has a first fixed portion and a second movable portion. The first portion is attachable to the housing proximate to the window. The second portion is connected to the first portion and movable relative thereto, and is releasably lockable to the first portion or to the housing for retaining an edge of the lamp assembly. The clip secures the lamp assembly to the front wall of the housing allowing it to be visible through the window. In one embodiment, the first and second portion lock to each other, and the clip retains the edge of the lamp assembly by urging it against the housing.

The clip is a "locking" clip in the sense that it is capable of securely holding. The clip may act to create a releasable lock against the housing of the traffic signal or it may lock to itself (i.e. the first and second portions lock together). The secure holding may be provided by simple friction.

The lamp assembly is intended to encompass an LED lamp kit, or an incandescent-type dome lens with attached gasket, or another assembly (not necessarily including a light bulb) that has a light-transmitting structure.

Preferably, the second portion is hingedly joined to the first portion and folds over the first portion for locking.

In the alternative, the second portion may have a sliding connection to the first portion. Thus, the second portion has:

- a first slide position in which the second portion is locked to the first portion or to the housing for securing the lamp assembly, and
- a second slide position in which the second portion is unlocked from the first portion or from the housing for releasing the lamp assembly.

In the further alternative, the second portion may have a rotatable connection to the first portion. Thus, the second portion has:

- a first rotated position in which the second portion is locked to the first portion or to the housing for securing the lamp assembly, and
- a second rotated position in which the second portion is unlocked from the first portion or from the housing for releasing the lamp assembly.

Returning to the preferred (hinged) embodiment, the clip may further comprise a locking wedge on one of the second portion or the first portion and a locking slot on the other of the second portion or the first portion for releasably receiving the locking wedge. Preferably, the locking wedge is on the first portion and the locking slot is on the second portion. The locking slot may further comprise a gripping edge, and the locking wedge may further comprise a gripping projection, allowing the gripping edge of the slot to catch on the gripping projection when the second portion and the first portion are folded together. Preferably, the locking slot is unlockable from the locking wedge by pushing on the locking wedge to uncatch the gripping projection from the gripping edge. Preferably, the locking slot is manually unlockable from the locking wedge.

The second portion and the first portion may be joined to each other by a natural hinge. For instance, a single piece of material may be integrally folded to form a natural hinge to form the main body of the clip.

Various materials are possible for the clip. The clip may be a plastic clip, or a metal clip, for instance, or the clip may be made of multiple materials in different parts. For instance, instead of a natural hinge, the clip may use a separate hinge element. The clip body (i.e. the first and second portions) may be made of plastic, while the hinge element may be made of metal. Various combinations are possible.

According to a second aspect of the invention, a traffic signal is provided. The traffic signal has a traffic signal housing with a front wall. A lamp assembly fits within a window in the front wall of the housing such that at least a portion of the lamp assembly is visible through the window. The lamp assembly is secured in the window by at least two locking clips installed on the front wall of the housing proximate to the window. Each clip has a first fixed portion and a second movable portion. The first portion is attached to the front wall of the housing. The second portion is connected to the first portion and movable relative thereto, and is releasably lockable to the first portion or to the housing. When locked, the clip acts to retain an edge of the lamp assembly.

The clips may be on an interior or exterior face of the front wall.

It will be understood that the first portion of the clip may be "attached" to the housing by some mechanical means (e.g. screw, rivet, bolt, etc.), by adhesive, or by welded or soldered joint. The clip may also be integrally molded with the housing.

According to a third aspect of the invention, a traffic signal is provided. The traffic signal has a traffic signal housing with a front wall. A lamp assembly fits within a window in the front wall of the housing such that at least a portion of the lamp assembly is visible through the window. The lamp assembly is secured in the window by at least two locking clips on the front wall of the housing proximate to the window. Each clip has a first fixed portion and a second movable portion. The first portion is integrally formed with the front wall of the housing. The second portion is connected to the first portion and movable relative thereto, and is releasably lockable to the first portion or to the housing. When locked, the clip acts to retain an edge of the lamp assembly.

The clips may be on an interior or exterior face of the front wall.

According to a fourth aspect of the invention, a system is provided for retaining a lamp assembly in a traffic signal housing. The housing has a front wall with a window sized to fit the lamp assembly. At least one top and one bottom locking clip are used to secure the lamp assembly in the window of the traffic signal housing. Each clip has:

a first portion attachable to the wall of the housing;

a second portion connected to the first portion and movable relative thereto, the second portion being releasably lockable to the first portion or to the housing for retaining an edge of the lamp assembly to secure the lamp assembly to the front wall of the housing allowing it to be visible through the window.

Preferably, the system further comprises fasteners for attaching the first portion of each clip to the wall of the housing. The fastener may itself be the "first portion" that attaches to the wall of the housing.

Preferably, the at least one top and one bottom locking clip comprises a pair of top locking clips and a pair of bottom locking clips. Preferably, the top and bottom locking clips are identical.

According to a fifth aspect of the invention, a lamp retaining system is provided for traffic signals having a housing having a front wall with a window and a lamp assembly sized to fit within the window. The system includes at least two upper locking clips and at least two lower holding members. The upper locking clips and lower holding members cooperate to securely but releasably hold the lamp assembly in the window of the traffic signal housing. Each locking clip comprises:

a first portion attachable to the wall of the housing proximate to an upper end of the window;

a second portion connected to the first portion and movable relative thereto, the second portion being releasably lockable to the first portion or to the housing for retaining an edge of the lamp assembly to secure the lamp assembly to the front wall of the housing allowing it to be visible through the window.

Each holding member comprises:

an attachment portion attachable to the wall proximate to a lower end of the window; and a holding portion extending outward from the attachment portion and adapted to loosely grip an edge of the lamp assembly.

Preferably, the system further comprises fasteners for attaching:

(a) the first portion of the upper locking clips to the wall of the housing proximate to the upper end of the window; and (b) the first portion of the lower holding members to the wall of the housing proximate to the lower end of the window.

According to a sixth aspect of the invention, a method is provided for replacing a lamp assembly in a traffic signal housing. The housing has a front wall defining a window in which the lamp assembly is mounted. The method comprises the following steps:

unlocking at least one locking clip that holds the lamp assembly by releasing a movable portion of the clip from either: (a) a fixed portion of the clip mounted on or integral with the front wall; or (b) the housing, without removing or loosening the clip from the housing;

removing the lamp assembly from the window;

replacing the lamp assembly with a replacement lamp assembly; and re-locking the at least one locking clip by closing or latching the movable portion to retain an edge of the replacement lamp assembly against the housing.

Preferably, the unlocking and re-locking steps are done by hand, without tools. All of the steps may be done by hand, without tools. Tools may be needed for installation of the clip at the outset, but regular maintenance is preferably tool-less and does not require removal of the clip from the housing.

DETAILED DESCRIPTION

Figure 1A:
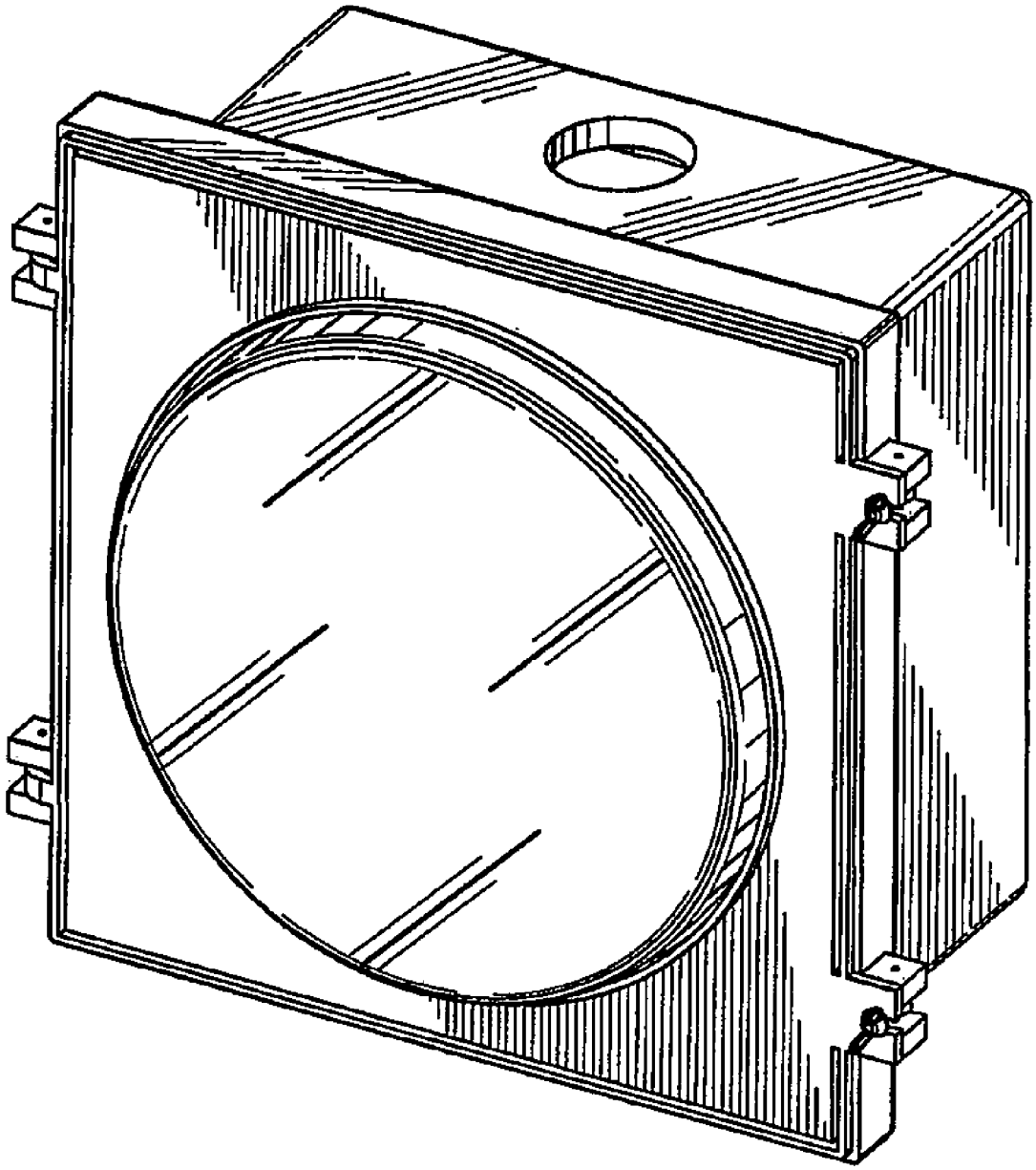
FIG.1A (PRIOR ART)
FIG. 1A is a perspective view of a traffic signal housing (prior art).

A traffic signal has a box-like housing. The light (from an incandescent light bulb or array of LED bulbs) shines through a lens which is visible through a window at the front of the housing. One standard arrangement is shown in FIG. 1A. The front door opens by unlatching side wing-nut closures. The front door, which is hinged, can swing open when the wing-nut closures are unlatched. With the front door open, a technician can access the light and power sources in the traffic signal.

Figure 1B:
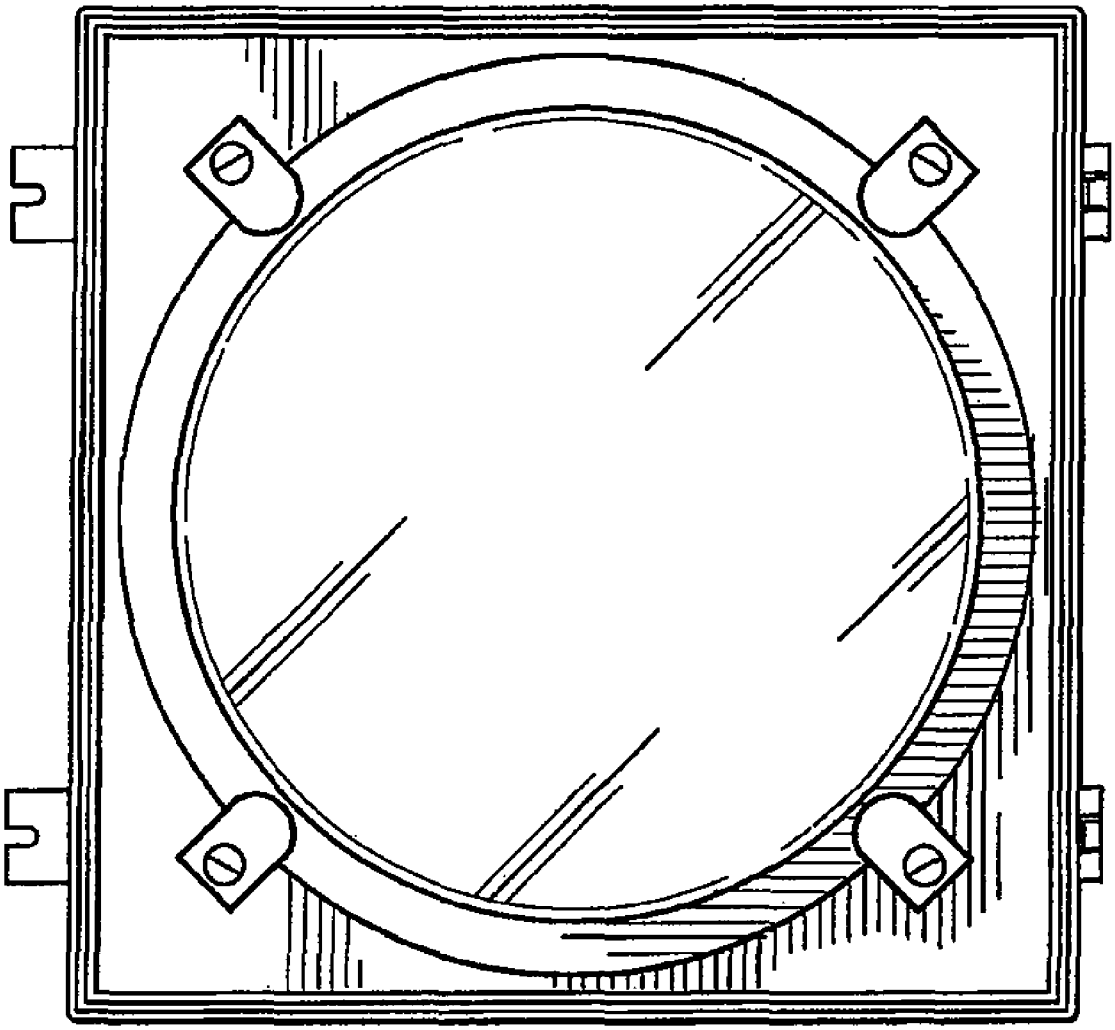
FIG.1B (PRIOR ART)
FIG. 1B is an inside view of the front wall of a conventional traffic signal housing showing conventional mounting brackets (prior art).

The front door of the housing has a window. In a conventional arrangement, the lens (for an incandescent light arrangement) or the LED lamp kit (with its own self-contained lens) is retained in the front window by inside-mounted mounting brackets, as shown in FIG. 1B. Each of these mounting brackets, commonly referred to as a "lens clip", is a substantially flat stamped piece of metal (usually stainless steel or aluminum) that is, more-or-less permanently, screwed onto the inside of the front door of the traffic signal housing (usually one in each corner).

To remove the lens or LED lamp kit retained using this arrangement, a technician must unscrew the screw and physically remove or substantially loosen the mounting bracket in each corner to release the lens or LED lamp kit. This is time-consuming and tricky for a technician working under less than optimum conditions.

The invention provides locking clips that can hold a lens or LED lamp kit but can also be released without removing the locking clip from the housing wall, allowing the lens or LED lamp kit to be easily removed and replaced.

Figure 2A:
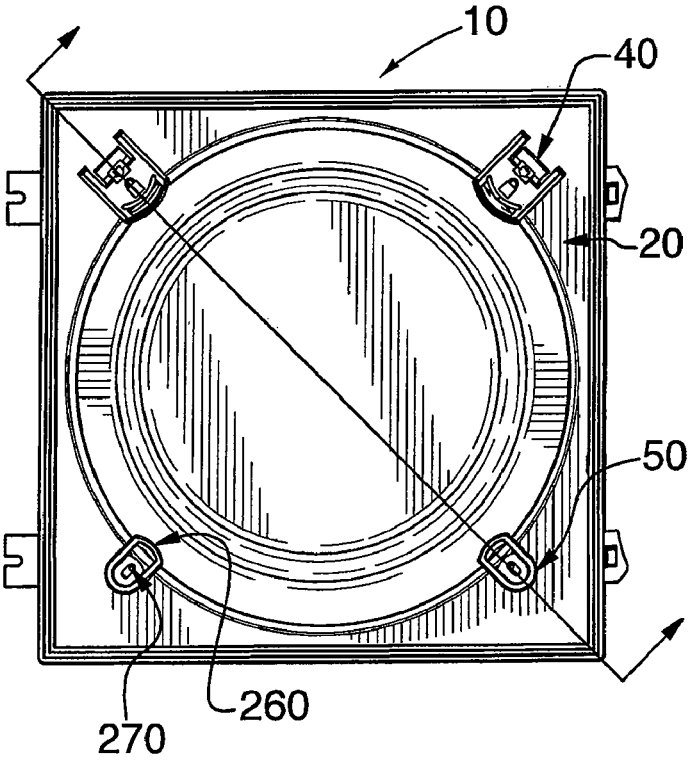
FIG. 2A is an inside view of a front wall showing a first embodiment of the present invention.

One possible arrangement of such locking clips is shown in FIG. 2A. FIG. 2A shows an inside face of the front wall 20 of the traffic signal housing 10. The locking clips 40 are positioned in two upper corners. These are fastened to, adhered to, or integral with the wall 20. As can be seen from the Figure, the clips 40 retain an edge of the LED lamp kit 30. Optional bottom holders 50 are also shown in this arrangement. Although an inside face of the front wall is shown, it is possible to mount the clips on the outside face, retaining the lens or LED lamp kit from the outside.

Figure 2B:
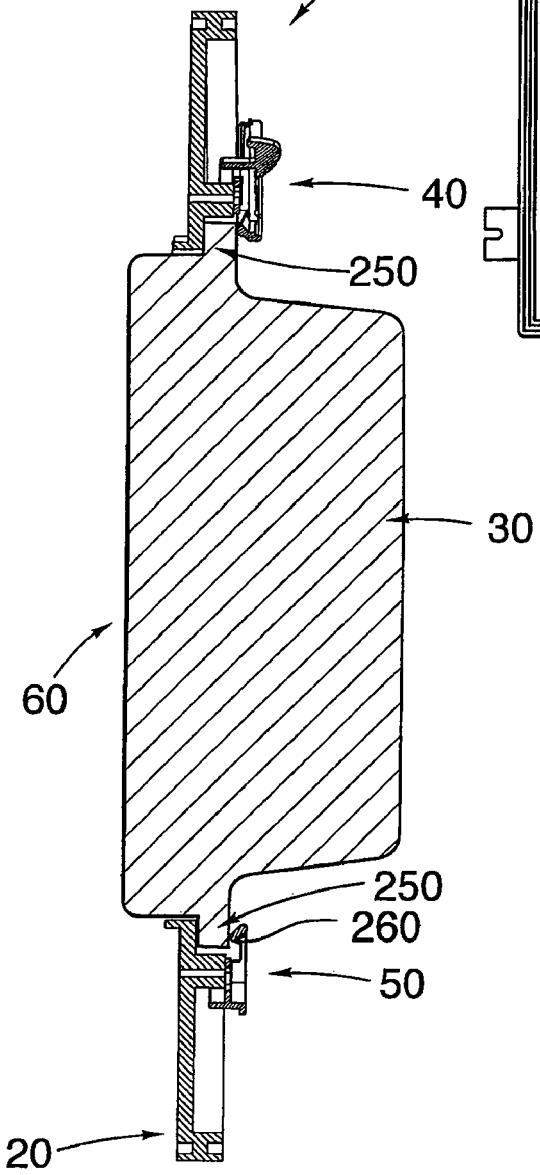
FIG. 2B is a sectional view of FIG. 2A.

FIG. 2B shows a sectional view of the front wall 20. In this case, an LED lamp kit 30 (having a built-in front lens 60) is retained by its edges 250 using the upper locking clips 40 and lower holders 50. The construction and specific features of the holders will be described in greater detail below.

Figure 3A:
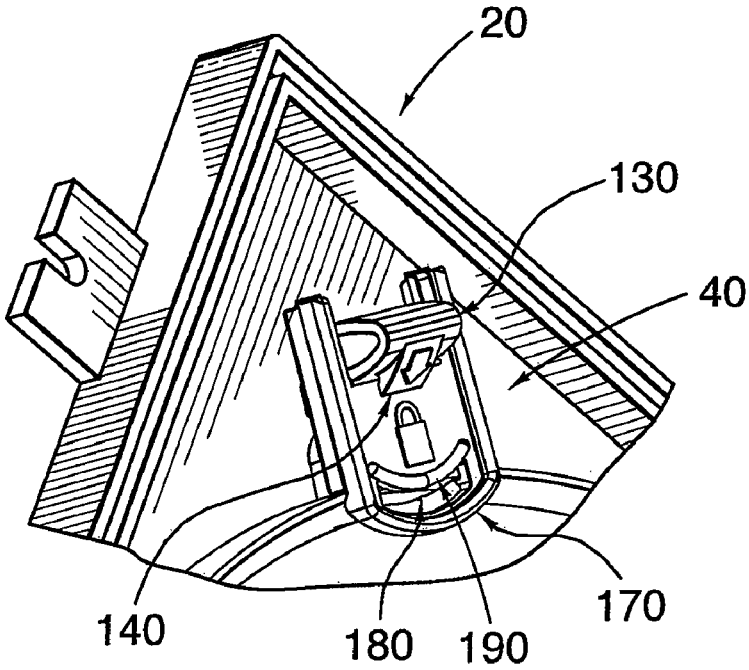
FIGS. 3A, 3B and 3C are detailed views of closed (locked), opening and fully open (unlocked) positions of the clip 40 shown in FIGS. 2A and 2B.
Figure 3B:
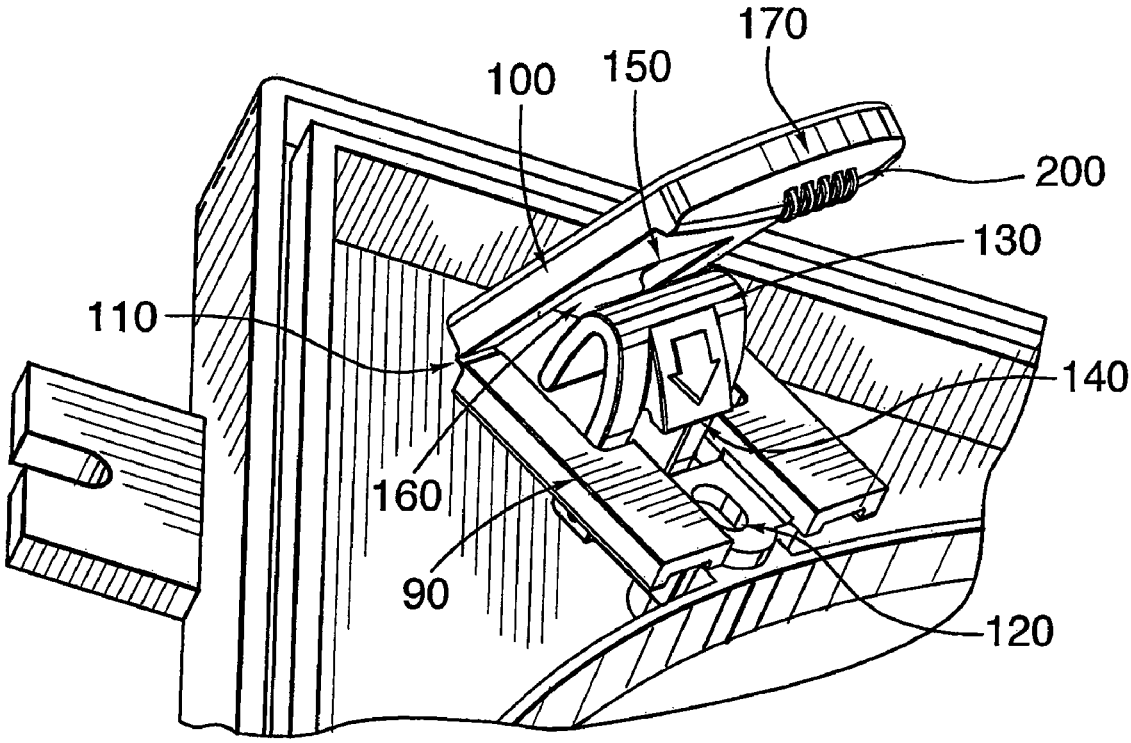
Figure 3C:
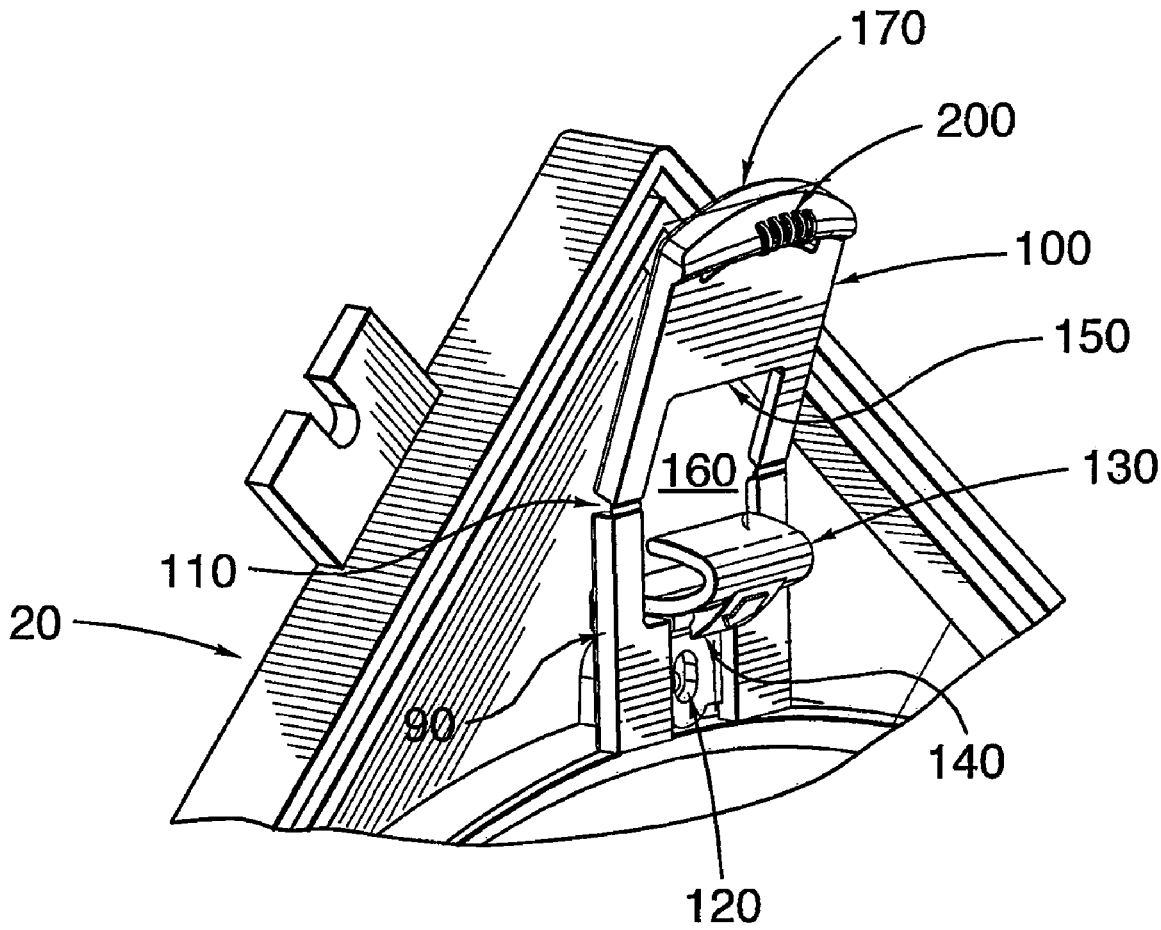

Various configurations of locking clips can be used to hold a lens or LED lamp kit (any kind of "lamp assembly") in the window of the housing, which can also be released without removing the locking clip from the housing wall. Three embodiments are described and illustrated in the drawings. The first embodiment (a foldable, self-locking clip) is shown in FIGS. 3A-3C.

The clip 40 has, generally speaking, an upper portion 100 and a lower portion 90. The upper portion is movable, while the lower portion remains fixed. The portions meet at a hinge 110. As shown, the hinge 110 may be a natural hinge, resulting from the fold of the two portions. Alternatively, a separate hardware piece may be used for the hinge (not shown). The clip 40 is attached to the wall 20 near the window 70, preferably so that it folds (closes) towards the window with the upper portion overhanging the window slightly. (The lower portion preferably does not extend into the window 70.) The clip may be fastened to the wall 20 using a conventional fastener (e.g. in screw hole 120). Alternatively, it may be adhered to or riveted to or molded with the wall 20.

On the lower portion of the locking clip 40 as shown, a locking wedge 130 may be provided. The locking wedge is preferably a resilient bent tab. On the upper portion of the locking clip, a locking slot 160 may be provided. Generally speaking, the clip is locked by interference between the locking wedge 130 and the locking slot 160. The clip in locked position is shown in FIG. 3A. Specifically, the locking wedge 130 has a gripping projection 140 which overlaps a gripping edge of the locking slot 160. The gripping projection holds the gripping edge, retaining the upper and lower portions of the clip together. The locking wedge and locking slot may be positioned generally behind the center of the clips (toward the hinge). The front edge of the clip holds the edge of the lamp assembly (in this case, an LED lamp kit 30), securing the lamp assembly within the window 70 of the housing. The upper portion of the clip may have a cutaway slot 180 toward the front edge 170 allowing the edge of the lamp kit to protrude through. A front reinforcement ridge 190 may further be provided which also bears upon the edge of the lamp assembly.

The locking clip may not lock in one single "click", but may have a graduated locking with multiple possible locked positions. For instance, the wedge may have multiple teeth that lock against the locking slot (like a ratchet). This adjustability may be preferred to accommodate varying thicknesses of the lamp assembly edge.

To release the locking clip, the locking wedge 130 is pushed back (i.e. toward the hinge 110). This uncatches the gripping projection 140 from the gripping edge 150 of the locking slot 160. With the gripping projection and gripping edge separated, the upper portion 100 may be lifted without obstruction, as shown in FIGS. 3B and 3C. A corrugated thumb grip 200 may be provided to allow the technician to easily push up the released upper portion 100.

Figure 4A:
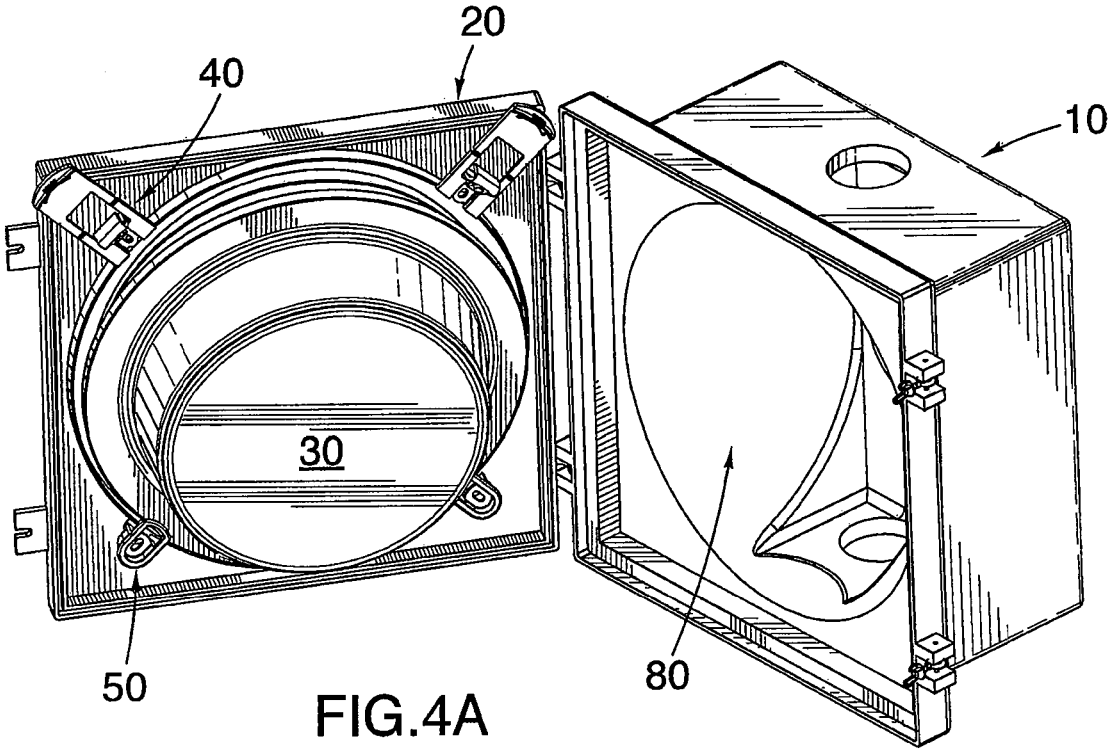
FIGS. 4A and 4B illustrate the removal of a lamp assembly 30 from traffic signal housing 10.
Figure 4B:
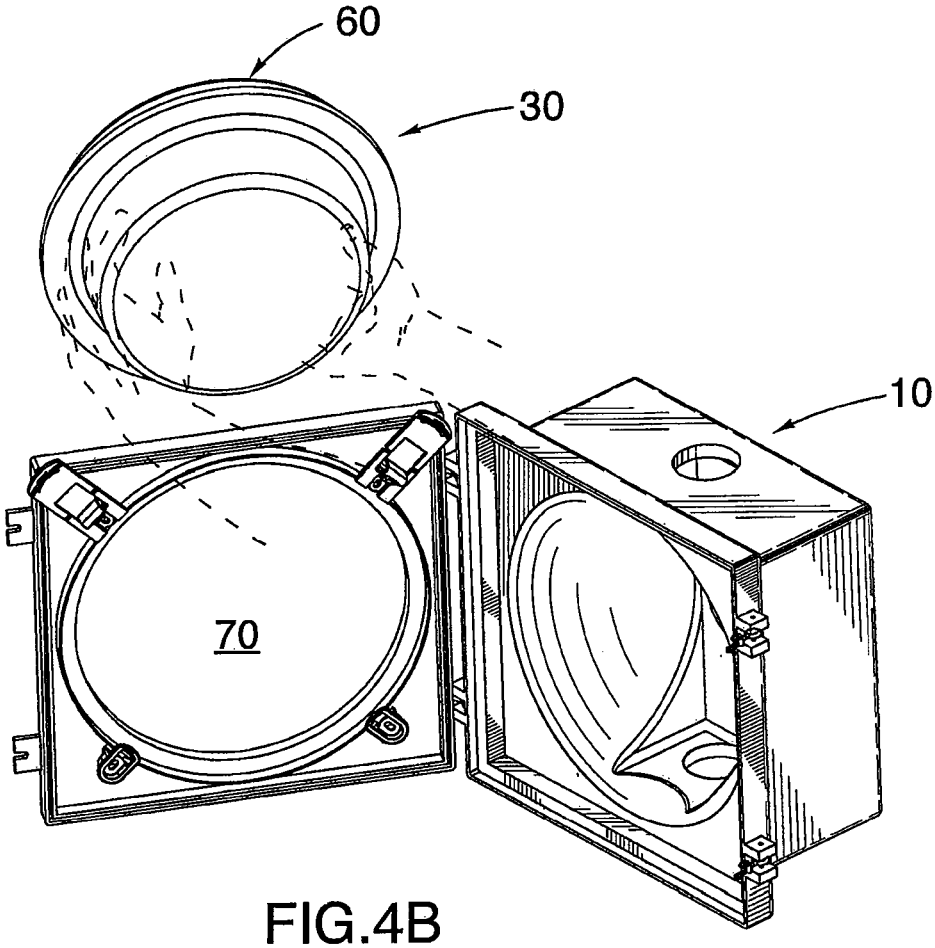

As shown in FIGS. 4A and 4B, once the locking clips 40 are released, the lamp kit 30 can be removed by hand from the housing (i.e. without tools). The lower holders 50 are not locking clips as such. They are fixed (generally L-shaped) brackets that are fixed (by screw or another fastening means) to the wall. As shown in FIGS. 2A and 2B, they have a projecting edge 260 that overlaps the window 70 to passively retain the edges 250 of the lamp kit 30, like a ledge on which the lamp kit rests. To remove the lamp kit 30, the locking clips 40 are opened and the lamp kit 30 is tilted slightly back (i.e. away from the wall) at the upper edges and slid upwards out of the L-shaped lower holders 50.

To insert a replacement lamp assembly, the process is simply reversed. The edge of the lamp kit is slid into the lower holders 50. The lamp kit is positioned in the window, preferably allowing the lens portion 60 to protrude out through the window 70. Then, the locking clips are locked by folding/closing the upper portions 100 of the clips down and over the lower portions 90. The natural springiness of the locking wedge 130 causes the gripping projection 140 and the gripping edge 150 to automatically catch, locking the clip together with the upper portion 100 overhanging and retaining the edge of the lamp kit. The lamp kit 30 fits within the cavity 80 of the housing 10. Once the replacement lamp kit is installed, the front door can be closed and the side wingnut closures can be reattached to secure the housing in a closed position. The housing 10 is preferably sealed around the edges of the door and around the juncture between the window 70 and lamp kit 30.

FIGS. 5A-5C and 6A-6C illustrate two other possible embodiments of locking clips for the same purpose.

Figure 5A:
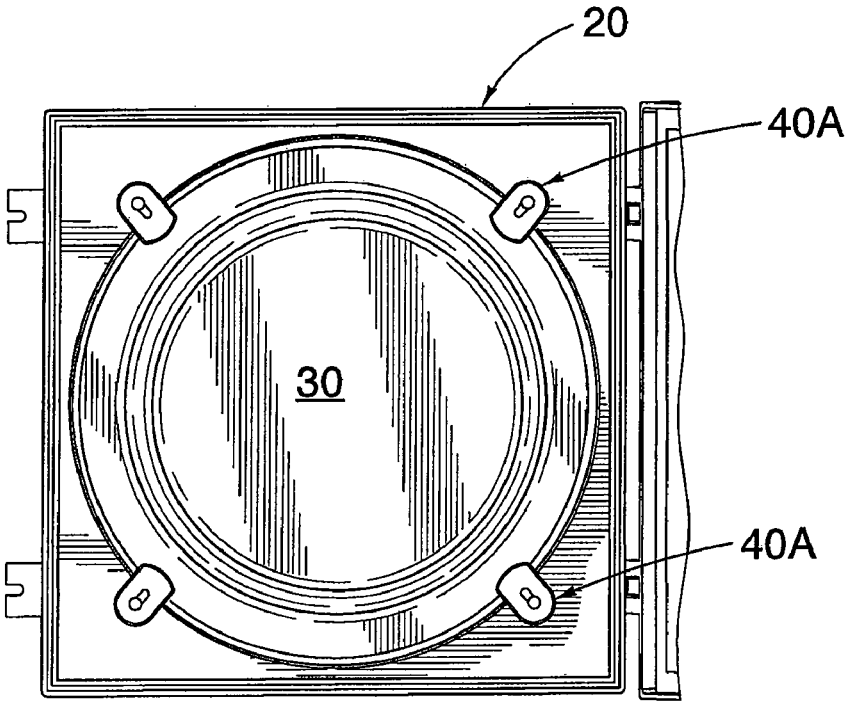
FIG. 5A is an inside view of a front wall showing a second embodiment of the present invention (with slide locking clips 40A).
Figure 5C:
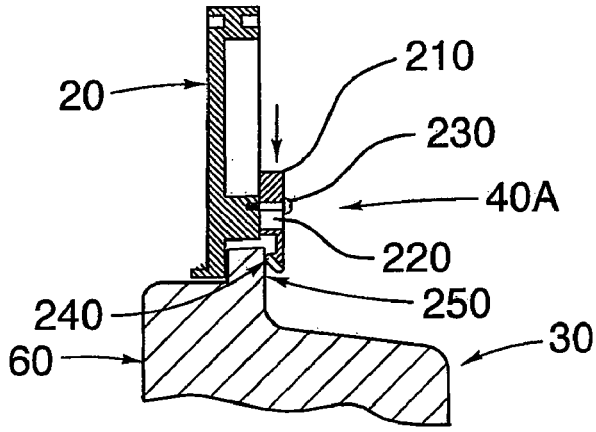
FIG. 5C is a cross-section along line A-A of FIG. 5B.
Figure 5B:
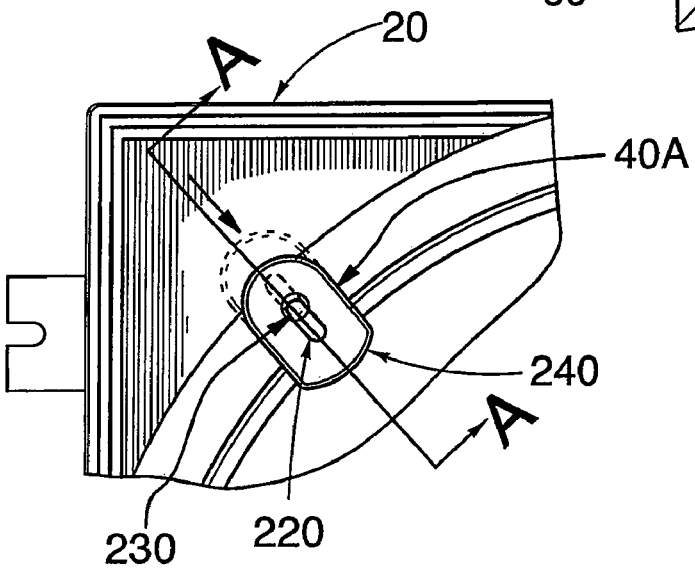
FIG. 5B is a detailed view of slide locking clip 40A shown in FIG. 5A with illustrated movement.

FIGS. 5A-5C show a slide locking clip 40A embodiment. Instead of having upper and lower portions that fold together to interlock, the clip 40A may use a slidable body portion 210 with a (preferably longitudinal) slot 220. The body portion 210 slides relative to a fixed element 230 (which may be a rivet, pin, screw, etc.) to lock and unlock the clip. The body portion has a forward edge 240 that overhangs the window 70 to retain the edge 250 of the lamp kit 30 when the clip is in the locked position. To unlock the clip, the body portion is slid away from the window (in this case, backwards), freeing the edge of the lamp kit. The "locking" is simply provided by the frictional engagement between the lamp kit and the front edge 240 of the body portion 210. Alternatively, the slide locking clip 40A may have a lower portion (not shown) that the body portion 210 slides upon. The lower portion is a fixed portion, which stays in place while the body portion is movable. The lower portion and body portion may lock together with locking features (such as a projecting dimple which interlocks with a cavity) on opposing surfaces of the body portion and the lower portion.

Different shapes of body portions and lower portions are possible. One possibility is to use a flanged body portion that is nested/snapped into a trough-shaped lower portion. The flanged body portion would slide along the trough for locking and unlocking. The body portion stays attached to the lower portion by side tabs in the trough that overhang a widened flange on the bottom of the body portion. This arrangement of tabs/flanges allows the body portion to move along the path of the trough without coming out.

Figure 6A:
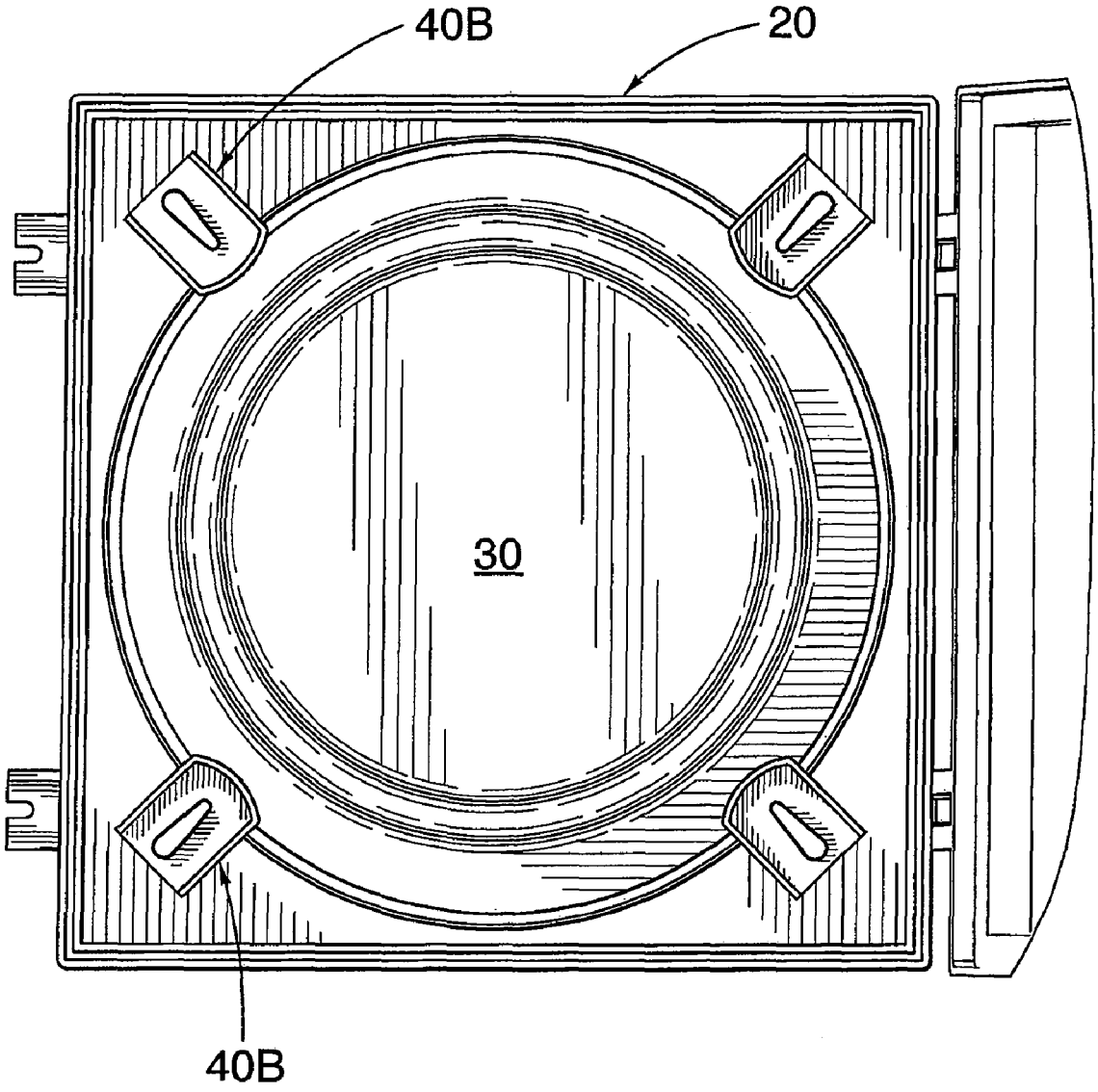
FIG. 6A is an inside view of a front wall showing a third embodiment of the present invention (with rotatable locking clips 40B).
Figure 6B:
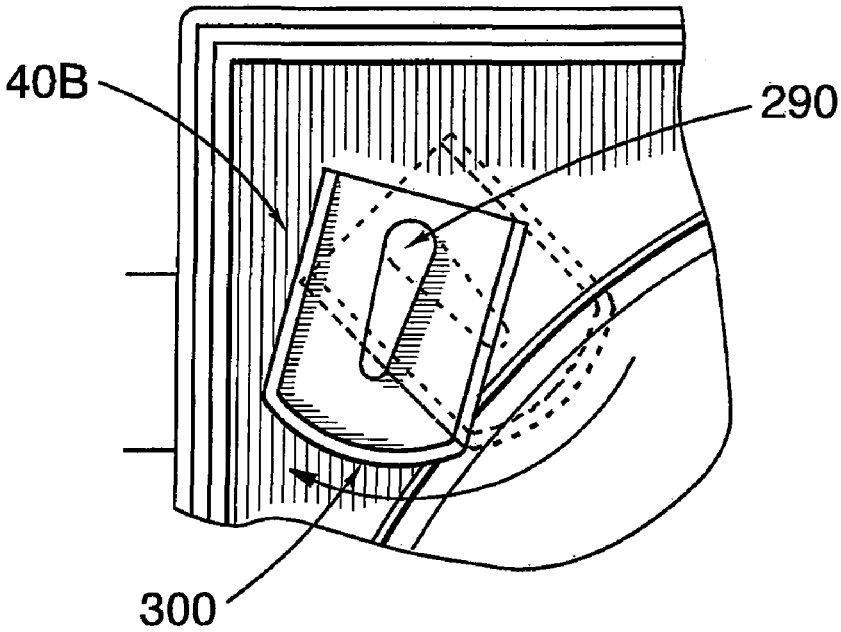
FIG. 6B is a detailed view of rotatable locking clip 40B shown in FIG. 6A (in open position) with illustrated movement.
Figure 6C:
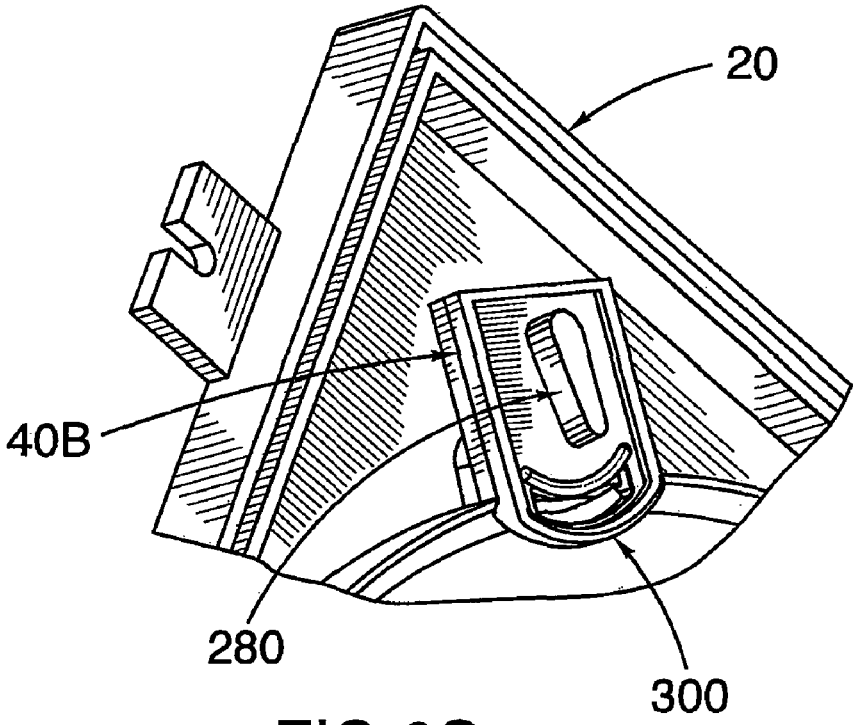
FIG. 6C is a detailed view of rotatable locking clip 40B (in closed position).

FIGS. 6A-6C show a rotatable locking clip 40B embodiment. The clip 40B uses a pivoting (rotating) body portion. To unlock the clip, handle 280 may be used to turn the clip about fixed pivot point 290 on a pin/fastener (not shown) to swing the forward edge 300 away from the window, freeing the edge of the lamp kit. The clip may be designed to swing to the side in one direction or in either direction, or may swivel in a 360 degree circle. The rotatable locking clip 40B may have a lower portion (not shown) that it rotates upon (i.e. above). Locking features (such as a projecting dimple which interlocks with a cavity) may be provided to retain the upper and lower portions and to assist in locating the centered position at which the lock is most fully engaged. The rotatable locking clip may alternatively use a trough design similar to the slide locking clip.

The locking clip in the slide or rotatable form may also include a spring or other biasing mechanism to provide constant downward pressure on the moving portion. The thickness of the edge of the lamp kit tends to push the movable portion of the clip upward. The spring would act to neutralize that tendancy.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What is claimed is:

1. A locking clip for attaching a lamp assembly to a traffic signal housing, the housing having a front wall defining a window through which the lamp assembly is visible, the clip comprising:

a first fixed portion attachable to the housing proximate to the window;

a second portion connected to the first portion and movable relative thereto, the second portion being releasably lockable to the first portion or to the housing for retaining an edge of the lamp assembly to secure the lamp assembly to the front wall of the housing allowing it to be visible through the window.

2. The clip of claim 1, wherein the second portion is hingedly joined to the first portion and folds over the first portion for locking.

3. The clip of claim 1, wherein the second portion has a sliding connection to the first portion, the second portion having:

a first slide position in which the second portion is locked to the first portion or to the housing for securing the lamp assembly, and a second slide position in which the second portion is unlocked from the first portion or from the housing for releasing the lamp assembly.

4. The clip of claim 1, wherein the second portion has a rotatable connection to the first portion, the second portion having:

a first rotated position in which the second portion is locked to the first portion or to the housing for securing the lamp assembly, and a second rotated position in which the second portion is unlocked from the first portion or from the housing for releasing the lamp assembly.

5. The clip of claim 2, further comprising a locking wedge on one of the second portion or the first portion and a locking slot on the other of the second portion or the first portion for releasably receiving the locking wedge.

6. The clip of claim 5, wherein the locking wedge is on the first portion and the locking slot is on the second portion.

7. The clip of claim 5, wherein the locking slot further comprises a gripping edge and the locking wedge further comprises a gripping projection, the gripping edge of the slot catching on the gripping projection when the second portion and the first portion are folded together.

8. The clip of claim 7, wherein the locking slot is unlockable from the locking wedge by pushing on the locking wedge to uncatch the gripping projection from the gripping edge.

9. The clip of claim 5, wherein the locking slot is manually unlockable from the locking wedge.

10. The clip of claim 2, wherein the second portion and the first portion are joined by a natural hinge.

11. The clip of claim 2, wherein the clip comprises a single piece of material integrally folded at a natural hinge.

12. The clip of claim 1, wherein the clip is made at least in part of plastic.

13. The clip of claim 1, wherein the clip is made at least in part of metal.

14. A traffic signal, comprising:

a traffic signal housing, the housing having a front wall with a window;

a lamp assembly sized to fit within the window with at least a portion of the lamp assembly visible through the window;

at least two locking clips installed on the wall of the housing proximate to the window for securing the lamp assembly in the window; each clip comprising:

a first fixed portion attached to the front wall of the housing;

a second portion connected to the first portion and movable relative thereto, the second portion being releasably lockable to the first portion or to the housing for retaining an edge of the lamp assembly to secure the lamp assembly to the front wall of the housing allowing it to be visible through the window.

15. A traffic signal, comprising:

a traffic signal housing, the housing having a front wall with a window;

a lamp assembly sized to fit within the window with at least a portion of the lamp assembly visible through the window;

at least two locking clips on the wall of the housing proximate to the window for securing the lamp assembly in the window; each clip comprising:

a first fixed portion integrally formed with the front wall of the housing;

a second portion connected to the first portion and movable relative thereto, the second portion being releasably lockable to the first portion or to the housing for retaining an edge of the lamp assembly to secure the lamp assembly to the front wall of the housing allowing it to be visible through the window.

16. The system of claim 15, wherein the clips are on an exterior face of the front wall.

17. The system of claim 15, wherein the clips are on an interior face of the front wall.

18. A system for retaining a lamp assembly in a traffic signal housing, the housing having a front wall with a window sized to fit the lamp assembly, the system comprising:

at least one top and one bottom locking clip for securing the lamp assembly in the window of the traffic signal housing; each clip comprising:

a first portion attachable to the wall of the housing;

a second portion connected to the first portion and movable relative thereto, the second portion being releasably lockable to the first portion or to the housing for retaining an edge of the lamp assembly to secure the lamp assembly to the front wall of the housing allowing it to be visible through the window.

19. The system of claim 18, further comprising fasteners for attaching the first portion of each clip to the wall of the housing.

20. The system of claim 18, wherein the at least one top and one bottom locking clip comprises a pair of top locking clips and a pair of bottom locking clips.

21. The system of claim 20, wherein the top and bottom locking clips are identical.

22. A lamp retaining system for traffic signal having a housing having a front wall with a window and a lamp assembly sized to fit within the window, the system comprising:

at least two upper locking clips, each locking clip comprising:

a first portion attachable to the wall of the housing proximate to an upper end of the window;

a second portion connected to the first portion and movable relative thereto, the second portion being releasably lockable to the first portion or to the housing for retaining an edge of the lamp assembly to secure the lamp assembly to the front wall of the housing allowing it to be visible through the window;

at least two lower holding members, each holding member comprising:

an attachment portion attachable to the wall proximate to a lower end of the window;

a holding portion extending outward from the attachment portion and adapted to loosely grip an edge of the lamp assembly;

wherein the upper locking clips and the lower holding members cooperate to securely but releasably hold the lamp assembly in the window of the traffic signal housing.

23. The system of claim 22, further comprising fasteners for attaching:

(a) the first portion of the upper locking clips to the wall of the housing proximate to the upper end of the window; and (b) the first portion of the lower holding members to the wall of the housing proximate to the lower end of the window.

24. A method of replacing a lamp assembly in a traffic signal housing, the housing having a front wall defining a window in which the lamp assembly is mounted, the method comprising:

unlocking at least one locking clip that holds the lamp assembly by releasing a movable portion of the clip from either: (a) a fixed portion of the clip mounted on or integral with the front wall; or (b) the housing, without removing or loosening the clip from the housing;

removing the lamp assembly from the window;

replacing the lamp assembly with a replacement lamp assembly; and re-locking the at least one locking clip by closing or latching the movable portion to retain an edge of the replacement lamp assembly against the housing.

25. The method of claim 24, wherein the unlocking and re-locking steps are done by hand, without tools.

26. The method of claim 24, wherein all steps of the method are done by hand, without tools.

* * * * *